US005435166A

United States Patent [19]

Sunada

[11] Patent Number: 5,435,166

[45] Date of Patent: Jul. 25, 1995

[54] DIE CUSHION DEVICE FOR PRESS

[75] Inventor: Masahide Sunada, Ishikawa, Japan

[73] Assignee: Kabushiki Kaisha Komatsu Seisakusho, Tokyo, Japan

[21] Appl. No.: 150,201

[22] PCT Filed: Jun. 29, 1992

[86] PCT No.: PCT/JP92/00822

§ 371 Date: Dec. 10, 1993

§ 102(e) Date: Dec. 10, 1993

[87] PCT Pub. No.: WO93/01012

PCT Pub. Date: Jan. 21, 1993

[30] Foreign Application Priority Data

| | | | |
|---|---|---|---|
| Jul. 1, 1991 | [JP] | Japan | 3-185797 |
| Jun. 15, 1992 | [JP] | Japan | 4-178888 |
| Jun. 15, 1992 | [JP] | Japan | 4-178889 |

[51] Int. Cl.[6] ..... B21D 22/22

[52] U.S. Cl. ..... 72/351; 72/449

[58] Field of Search ..... 72/23, 27, 347, 350, 72/351, 417, 449; 188/267; 267/75, 119, 130

[56] References Cited

U.S. PATENT DOCUMENTS

| | | | |
|---|---|---|---|
| 1,846,610 | 2/1932 | Rhodes | 72/351 |
| 2,130,528 | 9/1938 | Alexander | 188/267 |
| 3,023,799 | 3/1962 | Le Tourneau | 72/449 |
| 4,896,594 | 1/1990 | Baur et al. | 72/351 |

FOREIGN PATENT DOCUMENTS

| | | |
|---|---|---|
| 61-115627 | 6/1986 | Japan . |
| 63-36931 | 2/1988 | Japan . |
| 2-25538 | 7/1990 | Japan . |

*Primary Examiner*—Lowell A. Larson

*Attorney, Agent, or Firm*—Armstrong, Westerman, Hattori, McLeland & Naughton

[57] ABSTRACT

A die cushion device which is compact and simple construction to be constructed at low cost, comprises a pad arranged in a head of the press and supporting a lower die from below, and a cushion mechanism supporting the pad and providing a cushion force by controlling a servo motor. It is also possible to preliminarily assembly the pad and the cushion mechanism to use as a unit.

16 Claims, 13 Drawing Sheets

DIE CUSHION DEVICE FOR PRESS

FIELD OF THE INVENTION

The present invention relates to a die cushion device for a press to obtain a cushion effect by means of a servo motor. The invention relates to a die cushion device which obtains a cushion effect by a numerical control of position and torque of a servo motor.

BACKGROUND ART

Conventionally, when drawing is performed for a workpiece by means of a press, a die cushion device is employed. The conventionally employed die cushion has been disclosed in Japanese Examined Utility Model Publication No. 2-25538. The disclosed die cushion comprises an air cylinder for elastically supporting a pad for providing a cushion and a hydraulic cylinder for controlling lowering speed of the pad. A flow rate of a working fluid discharged from the hydraulic cylinder is controlled by a numerically controlled servo valve so that necessary cushion force corresponding to the drawing process can be obtained.

However, the die cushion device comprising the air cylinder and the hydraulic cylinder, is large in size so as to require a large space for installation. Furthermore, since an expensive servo valve must be incorporated, the device per se becomes complicated and expensive.

In addition, in case press molding is to be performed through a plurality of steps, since each individual die cushion device is large in size and expensive as set out above, it is often practically impossible to install such die cushion devices for respective process steps in view of installation space and cost.

DISCLOSURE OF THE INVENTION

Therefore, it is an object of the present invention to provide a die cushion device which can solve the problems in the prior art as set forth above.

A more concrete object of the present invention is to provide a die cushion device for a press, which provides a cushion effect employing a servo motor.

A further object of the present invention is to provide a die cushion device for a press, which permits independent control of cushion force at various points.

A still further object of the present invention is to provide a die cushion device for a press, in which the die cushion device is constructed as a unit and can be adapted to respective process steps in a press molding through a plurality of process steps by employing the units in combination.

In order to accomplish the above-mentioned objects, a die cushion device for a press, according to the first aspect of the invention, comprises a pad arranged in a head of the press and supporting a lower die from below, and a cushion mechanism supporting the pad and providing a cushion force by controlling a servo motor.

According to the second aspect of the invention, a die cushion device for a press comprises a plurality of pad members forming a pad for supporting a lower die from below via a cushion pin, a rack lever connected to each pad member, a servo motor provided corresponding to each pad member, a reduction gear train for connecting the servo motor and the rack lever, and a numeric controller for numerically controlling each servo motor for providing a cushion force for each pad member.

According to the third aspect of the invention, a die cushion device comprises a die cushion unit formed by assembling a plurality of pad members forming a pad for supporting a lower die from below via a cushion pin, a servo motor, and a reduction gear train connecting between the rack lever and the servo motor, the die cushion unit being installed for a head in each step of press molding for producing a cushion force by numerically controlling the servomotor corresponding to press operation in each step.

The servo motor can be an electric motor. Also, the cushion mechanism may include means for converting rotational driving torque of the servo motor into a reciprocal motion energy. Also, the servo motor may initiate driving immediately before contact of divided dies of the press for preliminarily accelerating the corresponding pad.

On the other hand, the servo motor is controlled the speed, position and/or torque by a numeric controller.

Furthermore, the pad may be supported by a plurality of cushion mechanisms. Also, the each of the plurality of cushion mechanisms may comprise a reciprocating body supporting the pad and a gear train for converting the rotational driving torque of the servo motor into a reciprocating driving force of the reciprocating body, at least one gear of the gear train being drivingly cooperated with the corresponding gear provided in other cushion mechanism. Also, the pad may comprise a plurality of pad members operable independently of each other.

Furthermore, the pad and the cushion mechanism may form a preliminarily assembled unit, the unit is adapted to be installed in the press.

Also, the drive shafts of mutually opposingly arranged servo motors can be connected via coupling.

The plurality of pad members may be supported by respectively corresponding rack levers, each rack levers being driven by the corresponding servo motor controlled independently, and the cushion force in each pad is set corresponding to each step in a plurality of forming steps. Also, the plurality of pad members are supported by respectively corresponding rack levers, each rack levers being driven by the corresponding servo motor controlled synchronously with the other, and the cushion force in each pad is set corresponding to each step in a plurality of forming steps.

BEST MODE FOR IMPLEMENTING THE INVENTION

The preferred embodiments of the present invention will be discussed hereinafter with reference to the accompanying drawings.

Figure 1:
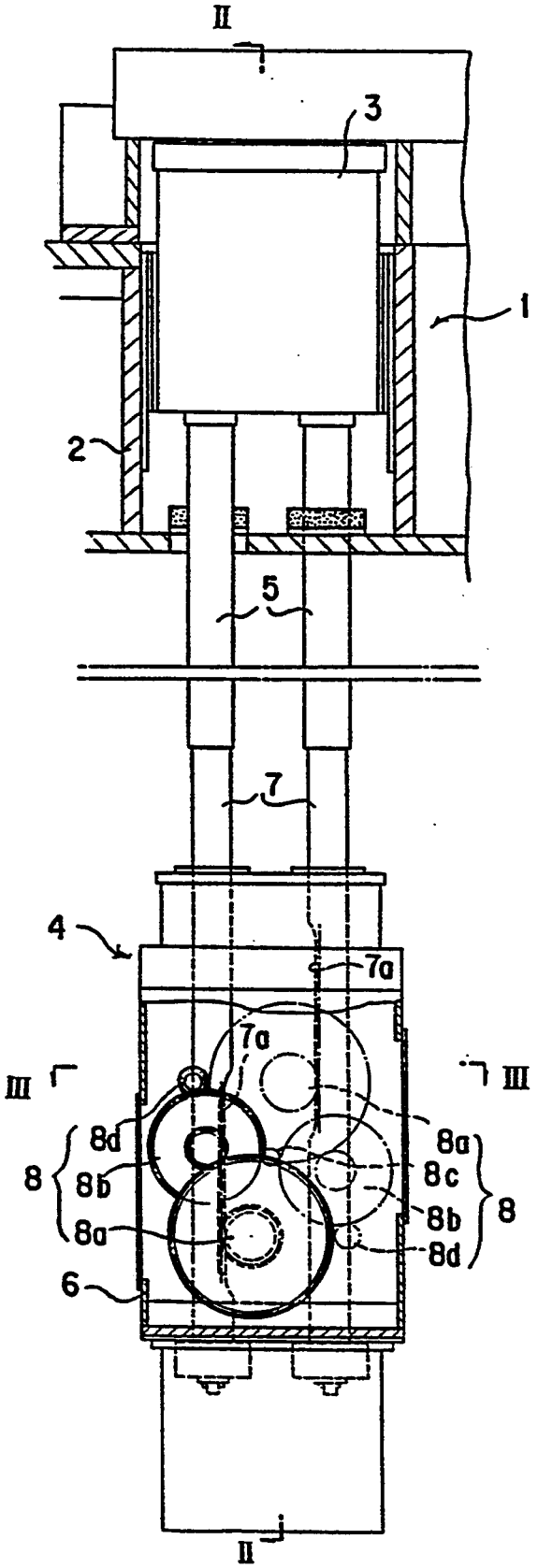
FIG. 1 is a section of the first embodiment of a die cushion device for a press according to the present invention.
Figure 2:
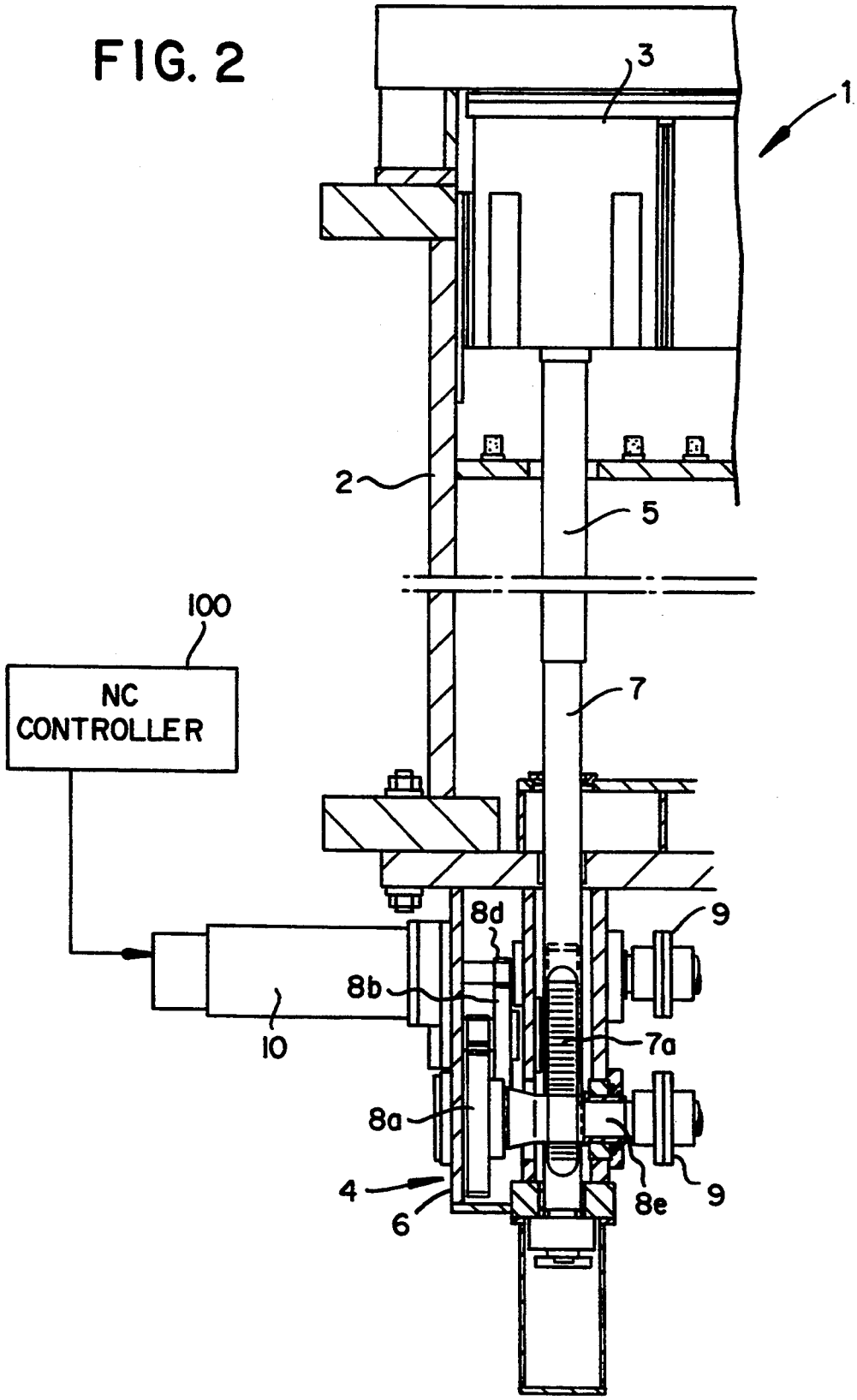
FIG. 2 is a section taken along line II—II of FIG. 1.
Figure 3:
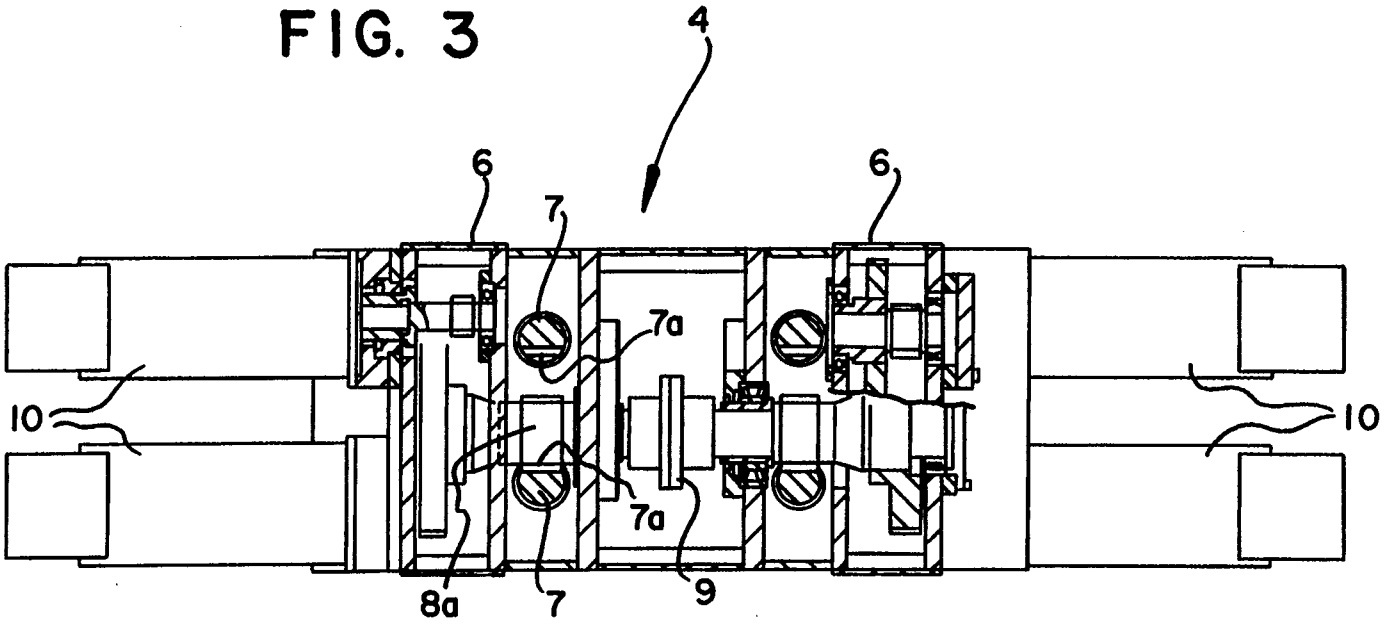
FIG. 3 is a section taken along line III—III of FIG. 1.
Figure 4:
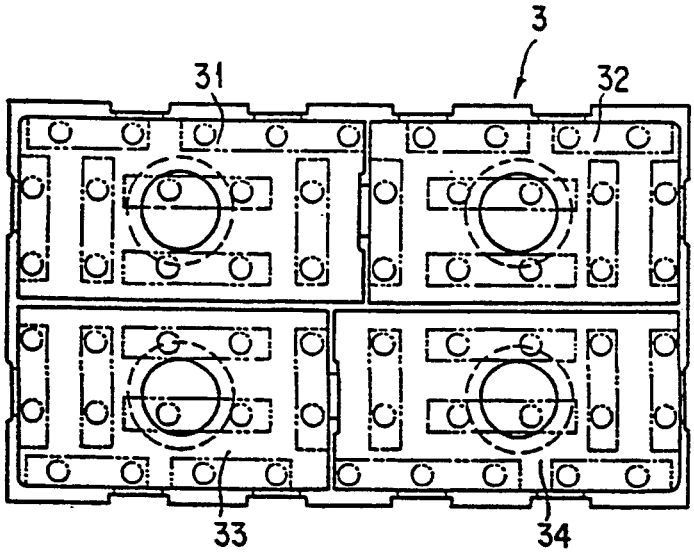
FIG. 4 is a plan view of the second embodiment of a die cushion device according to the present invention.
Figure 5:
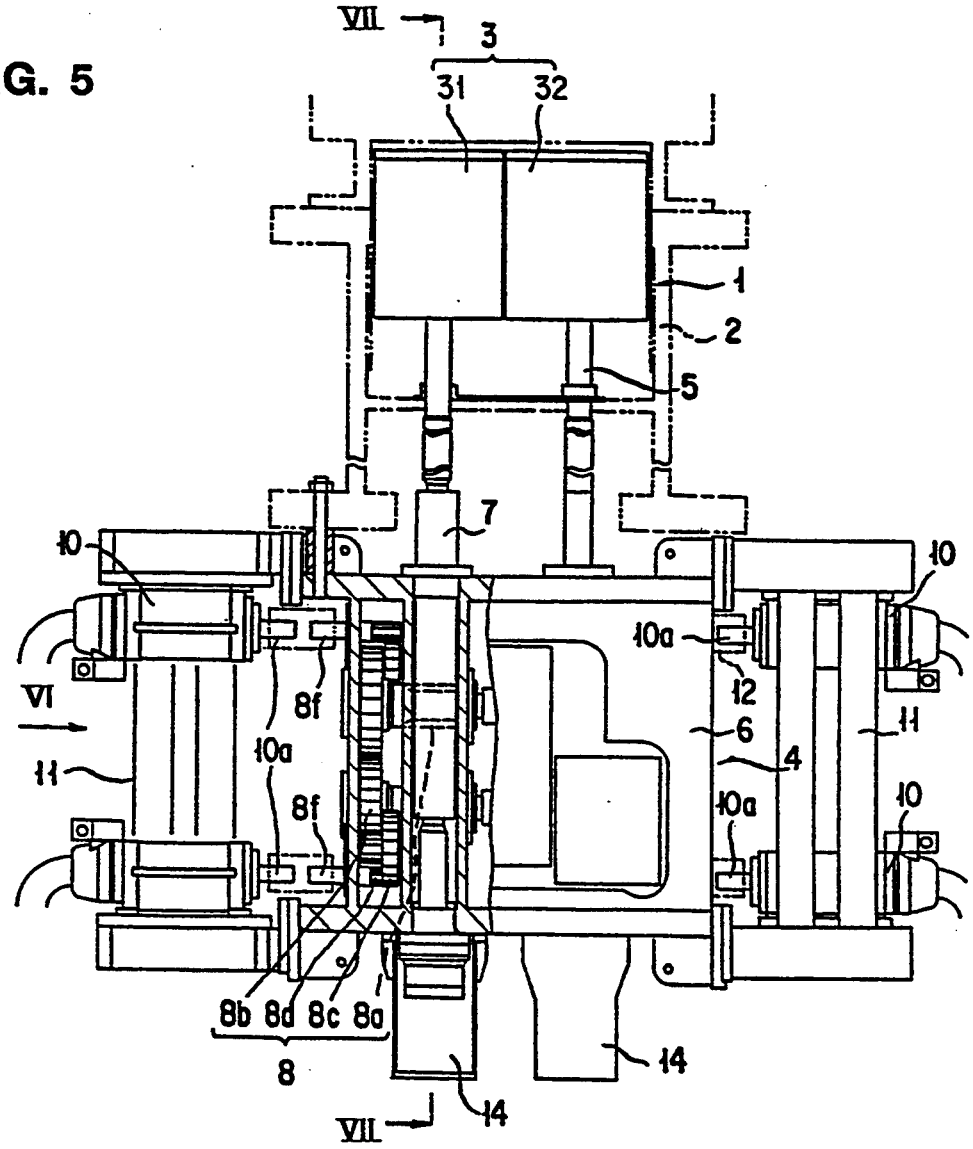
FIG. 5 is a side elevation of the die cushion device of the embodiment of FIG. 4, which is illustrated in partially cut out form.
Figure 6:
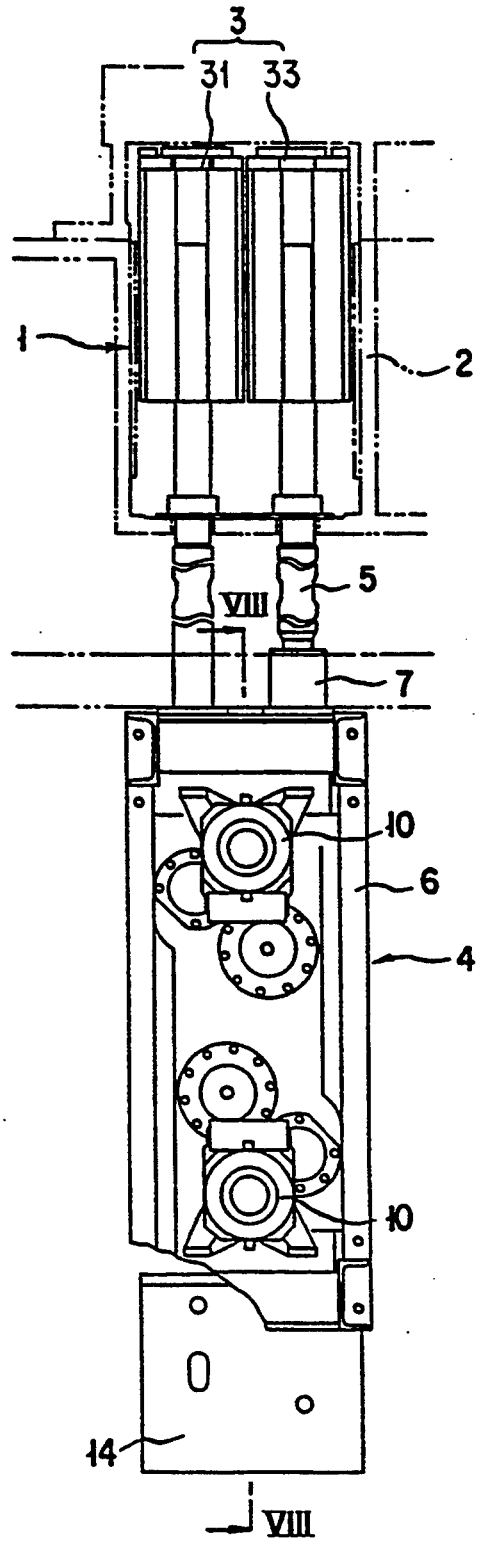
FIG. 6 is a section as viewed along line VI of FIG. 5.
Figure 7:
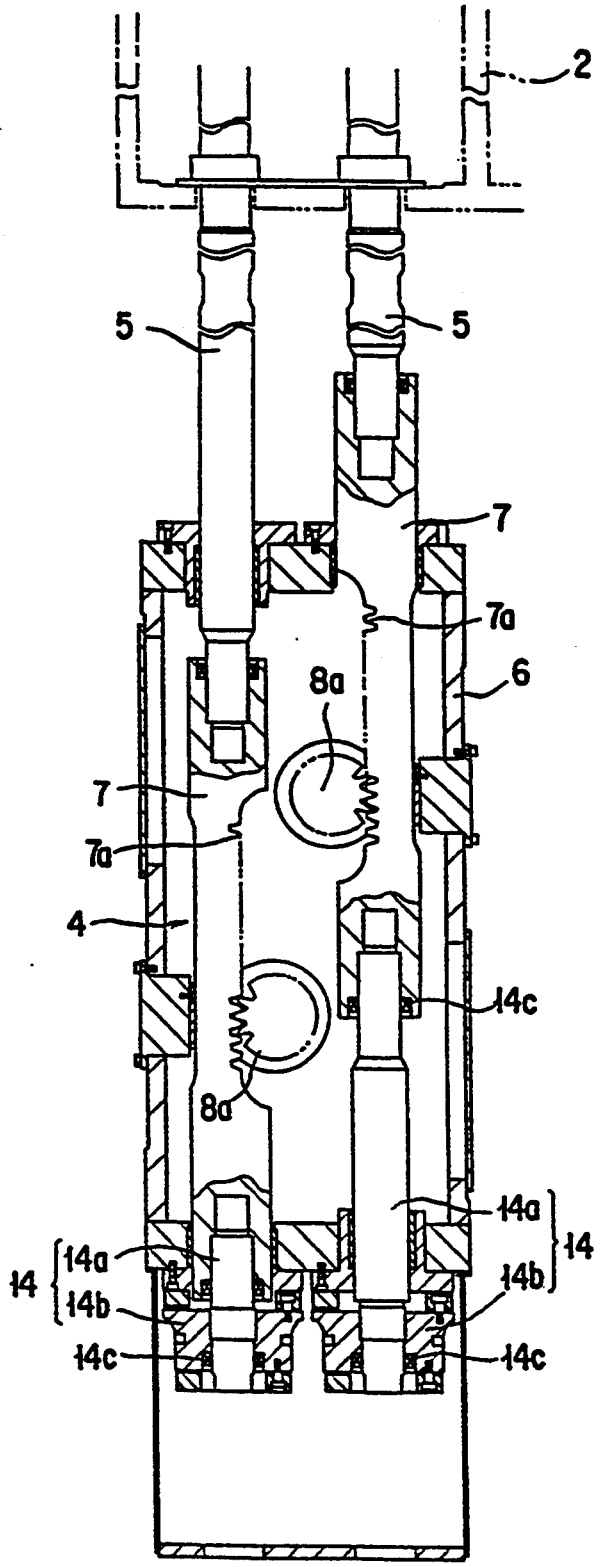
FIG. 7 is a section taken along line VII—VII of FIG. 5.
Figure 8:
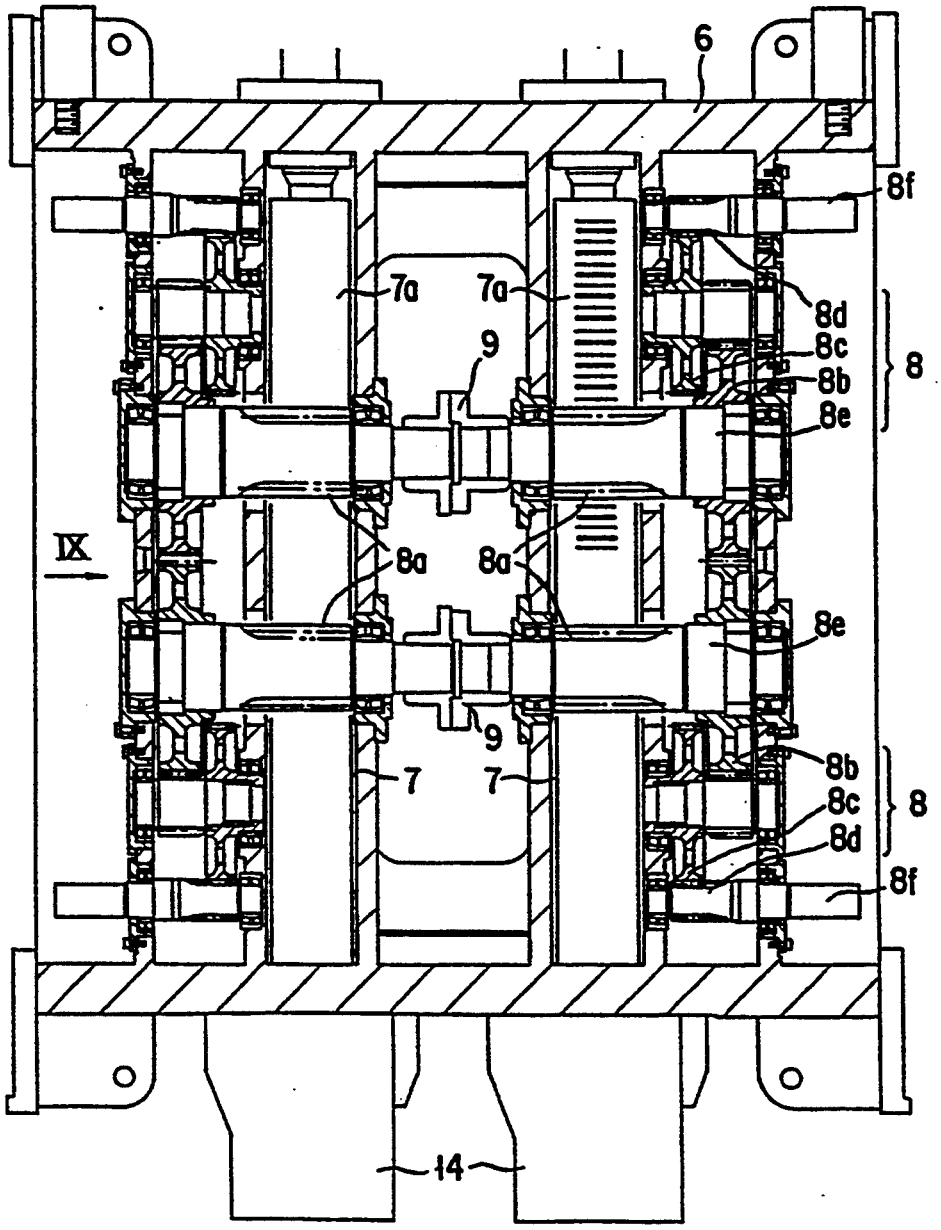
FIG. 8 is a section taken along line VIII—VIII of FIG. 6.
Figure 9:
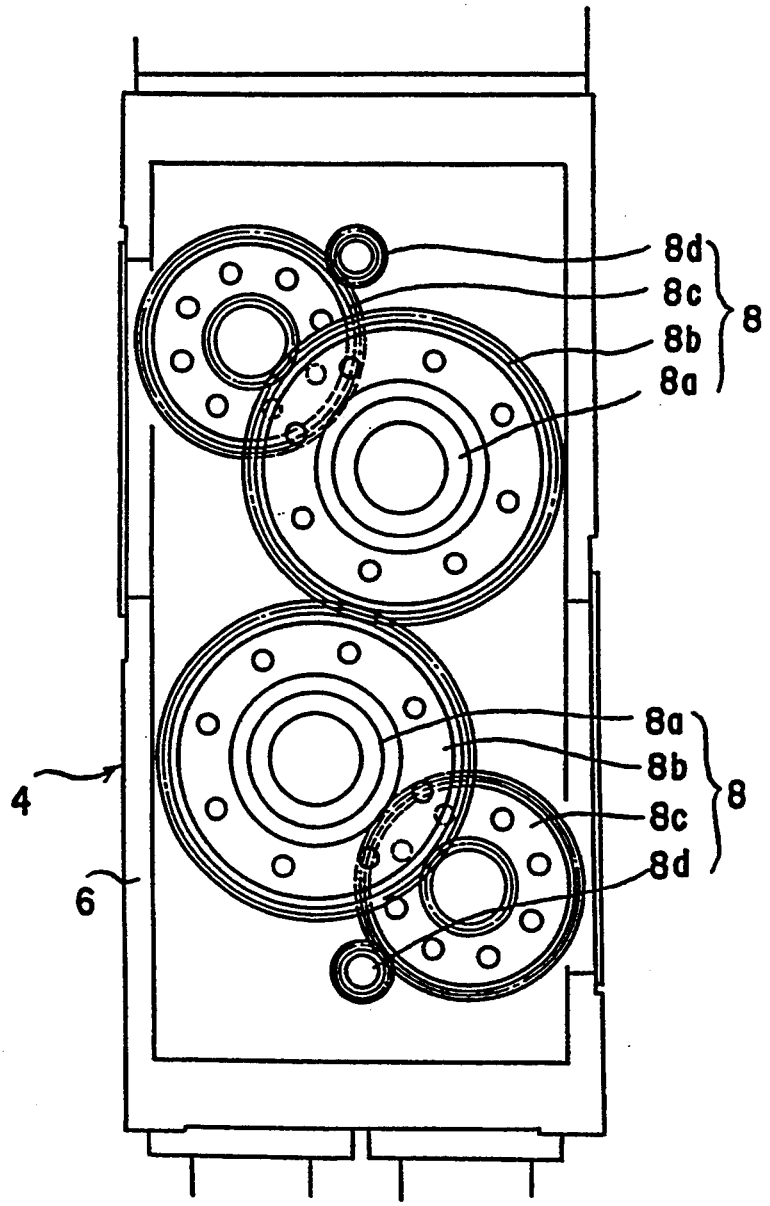
FIG. 9 is a section as viewed along line IX of FIG. 8.
Figure 10:
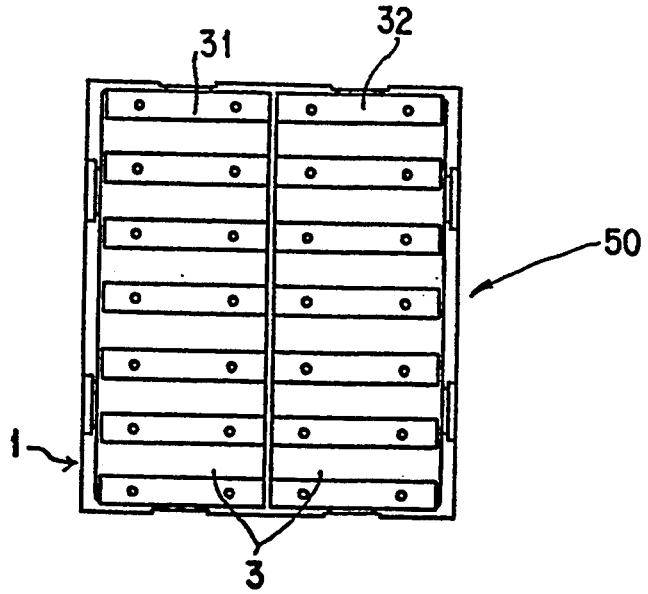
FIG. 10 is a plan view of the third embodiment of a die cushion device according to the present invention, which is constructed as a unit.
Figure 15:
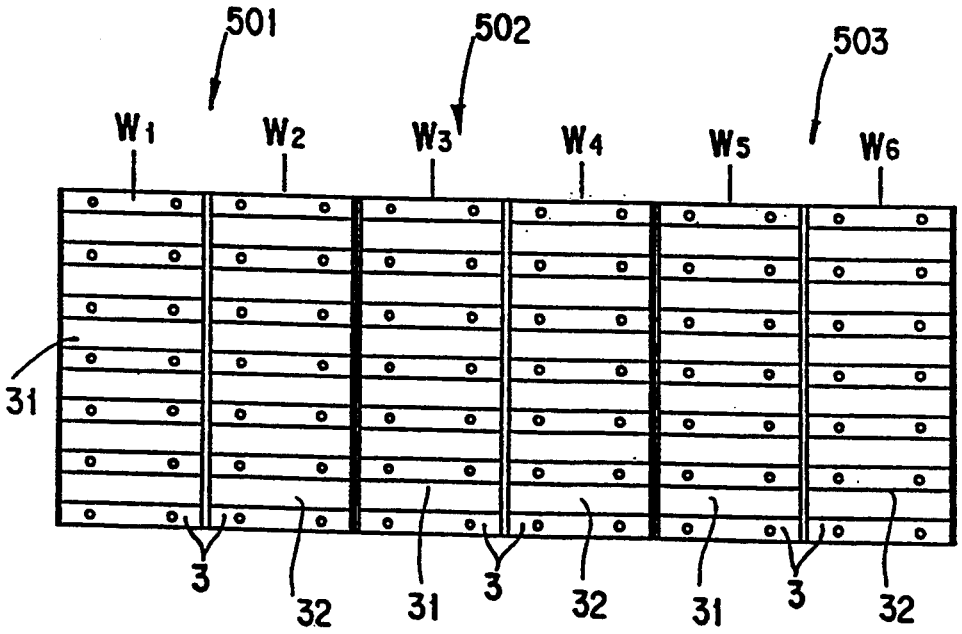
FIG. 15 is a plan view showing an example of arrangement of th die cushion devices which are constructed as unit according to the third embodiment.
Figure 11:
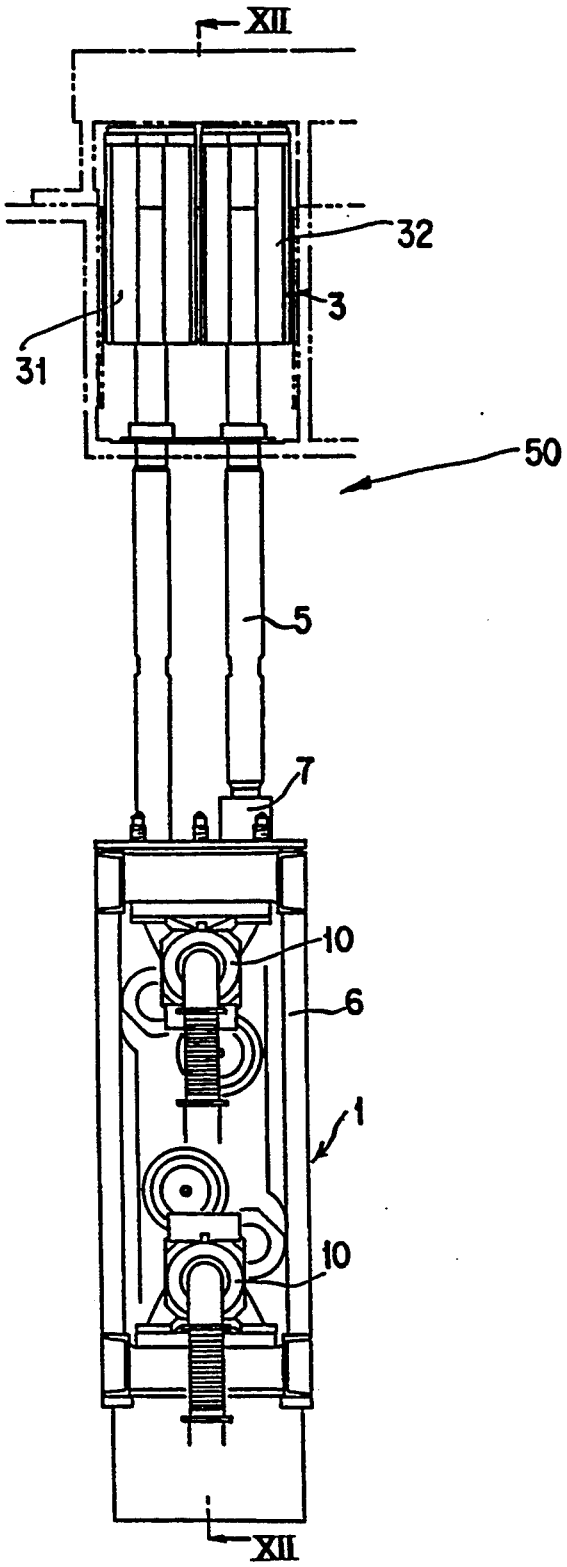
FIG. 11 is a side elevation of the die cushion device of FIG. 10.

FIGS. 1 to 3 show the first embodiment of a die cushion device 1 for a press, according to the present invention. The die cushion device 1 is arranged within a head 2 arranged below a lower die (not shown) of a press via a plurality of cushion pins (not shown) in a per se known manner. The die cushion device 1 has a pad 3 for supporting the lower die. It should be noted that, in the shown embodiment, the pad 3 is supported by four cushion mechanisms 4.

The cushion mechanism 4 includes a support lever 5. The upper end portion of the support lever 5 fixedly connected to the pad 3. The lower end of the support lever 5 is connected to an upper end of a rack lever 7. The rack lever 7 is supported by a gear case 6 for movement in the vertical direction. On the portion of the rack lever disposed within the gear case 6, rack teeth 7*a* is formed. The rack teeth 7*a* meshes with smaller diameter gears of first stage gears 8*a* of a respective reduction gear trains 8 housed within the gear case 6.

Each reduction gear train 8 includes an intermediate gear 8*b* which has a smaller diameter gear meshed with a larger diameter gear of the first stage gear 8*a*. The intermediate gear 8*b* of each reduction gear train 8 are cooperated with the other via a cooperation gear On the other hand, the larger diameter gear of the intermediate gear 8*b* is meshed with a final stage gear 8*d*. On the rotary shaft 8*e* of the final stage gear 8*d* of each reduction gear train 8, a servo motor 10 which is mounted at the side of the gear case 6, is coupled via a coupling 9. Each servo motor 10 is connected to a numeric controller 100. The numeric controller 100 generates a speed command corresponding to a predetermined cushion force corresponding to the press process or a cushion force derived corresponding to respective parameters in the press process, to perform speed control of corresponding servo motor.

It should be appreciated that, in order to improve an accuracy in generating the cushion force and an accuracy in relative position control of the respective pads as much as possible, respective gears and the coupling portion are set to have possible minimum backlash.

It should be noted that though the numeric controller 100 is constructed to control necessary cushion force by speed control of the servo motor in the shown embodiment, the control of the servo motor can be done by torque control, position control and so forth. Also, though the shown embodiment employs a control algorithm to perform an open loop control depending upon the cushion force which is preliminarily set and derived on the basis of parameters of the press, it is possible to perform feedback control by monitoring behavior of the servo motor or the pad, if necessary.

Next, discussion will be given for the operation of the first embodiment of the die cushion device of the present invention set forth above.

When drawing of a workpiece is performed between upper and lower dies equipped on the not shown press, the upper die is initially lowered so that the peripheral portion of the workpiece is clamped by blank holder provided on the peripheries of the upper and lower dies. At this time, touch sound can be generated to be a cause of noise. Therefore, the servo motor 10 is activated immediately before the timing where the upper die comes into contact with the blank holder to lower the rack lever 7 to preliminarily accelerate the pad 3 downwardly. The magnitude of this preliminary acceleration is determined depending upon preliminarily set data corresponding to kinds of workpiece, die and so forth.

At this time, since the adjacent reduction gear trains are cooperated via the cooperation gear 8*c* interposed between the intermediate gears 8*b* and the rotary shafts 8*e* of the correspondingly arranged final stage gears 8*d* are coupled with the servo motors, each cushion mechanism 4 can precisely match the stroke position of the portion of the corresponding pad 3 with other portions. Also, the each cushion mechanism 4 can independently generate the necessary cushion force resisting against unbalanced load at the lower die of the press.

In the position where the peripheral portion of the workpiece is clamped between the upper die and the blank holder, the upper die is further lowered to perform drawing. According to progress of the drawing operation, the revolution speed of the servo motor 10 is controlled by the numeric controller to provide a necessary cushion force in the drawing for the pad 3 to further lower the pad 3. When a slide (not shown) of the press reaches a bottom dead point and thus drawing is completed, the servo motor 10 is driven in a reverse direction associating with rising of the slide to rise the pad 3.

In a certain kind of forming process, rocking for temporarily stopping the rising of the pad 3 becomes necessary. Such rocking operation can be easily achieved by stopping driving of the servo motor 10. Furthermore, when the workpiece is ejected to a transfer feeder after the completion of the forming process, a preliminary lift for temporarily stopping the workpiece at the height of transportation of the transfer feeder. This preliminary lift and preliminary lift magnitude can be easily set by controlling revolution of the servo motor 10.

As set forth above, according to the shown embodiment, the cushion effect of the pad 3 can be obtained only by control of the servo motor. Also, when the workpiece is metal, such as aluminum, it is possible to cause local wrinkle. However, according to the shown embodiment, the occurrence of a wrinkle can be avoided by permitting independent control of the servo motors in a plurality of cushion mechanisms to yield high quality products.

As set forth above, the first embodiment of the die cushion device according to the present invention makes it possible to arbitrarily set the cushion force corresponding to the step of forming process by providing the servo motor in the cushion mechanisms supporting the pads and the controller controlling the speed of the servo motor. Therefore, in comparison with the conventional die cushion device of a hydraulic drive type, in which the servo valve is numerically controlled, the overall derive becomes compact and the construction becomes simple. Also, the price can be lowered in the extent of one third of the conventional device.

Also, the shown embodiment of the die cushion device has higher response characteristics and higher reliability than the conventional die cushion device employing the hydraulic drive system, and can significantly shorten the period required for preparation, so to remarkably improve the workability. Also, by preliminarily accelerating the lower die downwardly before the upper die contacts with the lower die, touch sound can be reduced so as to lower the noise level.

FIGS. 4 to 9 show the second embodiment of a die cushion device according to the present invention. It should be noted that, in the following discussion, the components common to the foregoing first embodiment will be shown with the same reference numerals.

In the shown embodiment, the pad 3 is divided into a plurality of pad members 31, 32, 33 and 34. Each pad member 31, 32, 33 and 34 is arranged in the head 2 of the press for mutually independent operation with respect to each other. Each pad member 31, 32, 33 and 34 is supported by each independent cushion mechanism 4.

In each cushion mechanism 4, each independent numerically controlled servo motor 10 is provided. Similarly to the former embodiment, each servo motor 10 is mounted on the side of the gear case via a mounting bracket 11. The output shaft 10*a* of the servo motor 10 is coupled with the rotary shaft 8*e* of the final stage gear 8*d* of the corresponding reduction gear train 8.

It should be noted that the reduction gear train employed in the shown embodiment includes the initial stage gear 8*a* in a form of a pinion construction and an intermediate gear 8*b* provided coaxially with the initial stage gear, the intermediate gear 8*b* is coupled with the final gear 8*d* in a form of a pinion via a second intermediate gear 8*c*. On the other hand, the intermediate gear 8*b* is also meshed with the intermediate gear 8*b* of the adjacent another reduction gear train 8. By this, the each pad members 31, 32, 33 and 34 which are separated into a plurality of members can be synchronized in operation so that the relative positions of respective pad members can match to each other.

Furthermore, in the shown embodiment, a stopper mechanism 14 is provided adjacent to the lower end of the rack lever 7 downwardly extending from the gear case 6. The stopper mechanism 14 mechanically defines the extreme of the vertical stroke of the rack lever 7 for defining the range of stroke of the pad members 31, 32, 33 and 34. The stopper mechanism 14 has a stopper rod 148. The stopper rod 14*a* is connected to the rack lever 7 at the upper end and connected to a stopper member 14*b* at the lower end. Between the stopper rod 14*a* and the stopper member 14*b* a stroke adjusting shim 14*c* is interposed. By increasing and decreasing the length of the shim 14*c* in the axial direction, the strokes of each path members 31, 32, 33 and 34 can be adjusted.

It should be noted that each servomotor is effected position and torque control on the basis of the position command and the torque command provided from the numeric controller 100 to generate necessary cushion force.

Namely, in the numerical control in the shown embodiment, the relative stroke positions of respective pad members 31, 32, 33 and 34 are matched to each other by the position control and cooperation of the reduction gear trains as set forth above to maintain the support surface for the lower die of the press constantly in horizontal condition to avoid generation of stress on the lower die. Furthermore, in the shown embodiment, by controlling the torque generated by the servo motor 10 depending upon the load applied to the corresponding pad member via the lower die, it becomes possible to generate the cushion force depending upon the load. By this, sufficient cushion forces can be generated at respective pad members 31, 32, 33 and 34 in response to local concentration of load which is potentially caused in the lower die during the process of press operation.

Even in the second embodiment of the die cushion device set forth above, the equivalent effects and advantages discussed with respect to the first embodiment can be obtained. In addition, according to the shown embodiment, since the pad 3 is constituted of a plurality of independently operable pad members, it becomes possible to provide cushion control with high precision depending upon kind, shape of the workpiece to be processed or the die, or the forming condition.

FIGS. 10 to 15 shows the third embodiment of the die cushion device according to the present invention. The shown embodiment has a construction, in which the die cushion device having substantially the same construction to the second embodiment is constructed as a unit.

Namely, a die cushion unit 50 of the shown embodiment is constructed with two pad members 31 and 32. For each pad member 31 and 32, the cushion mechanism having the similar construction to that of the second embodiment is provided.

By installing the shown embodiment of the die cushion unit 50 in the head of one press, it becomes possible to adapt it for two steps of forming operations. On the other hand, by synchronously controlling the servo motors 10 in respective cushion mechanism 4, it becomes possible to adapt it for a single step forming employing two pad members 31 and 32.

Figure 12:
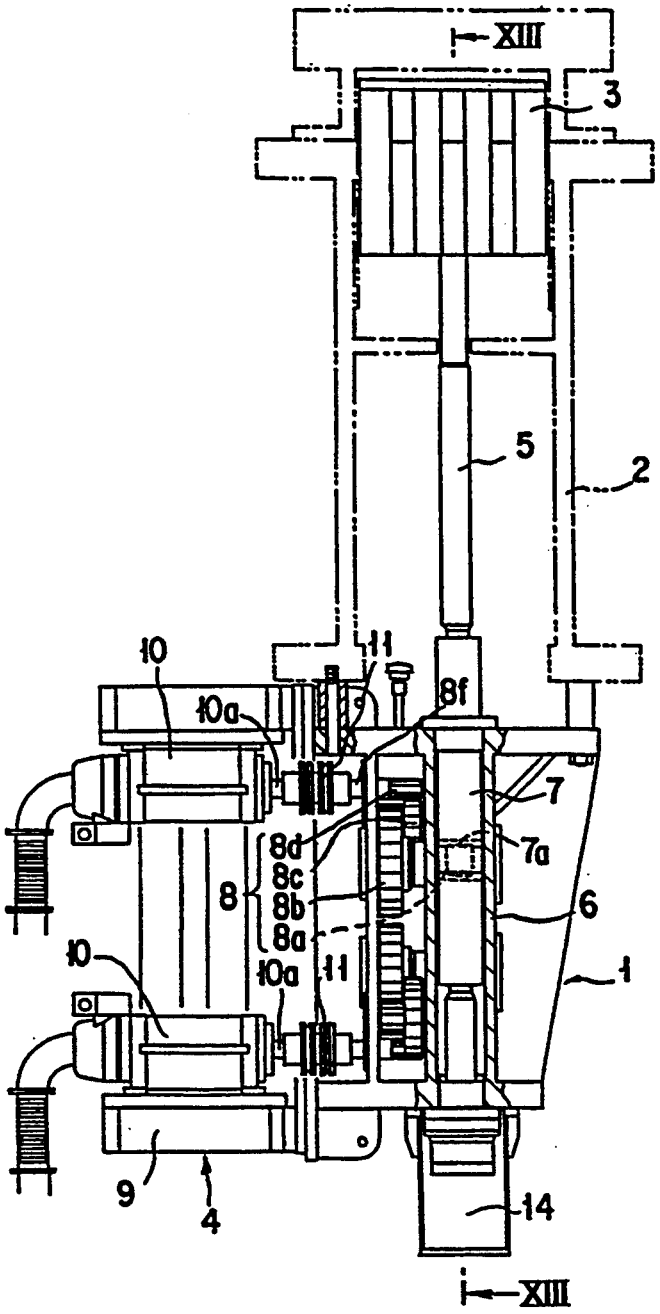
FIG. 12 is a section taken along line XII—XII of FIG.
Figure 13:
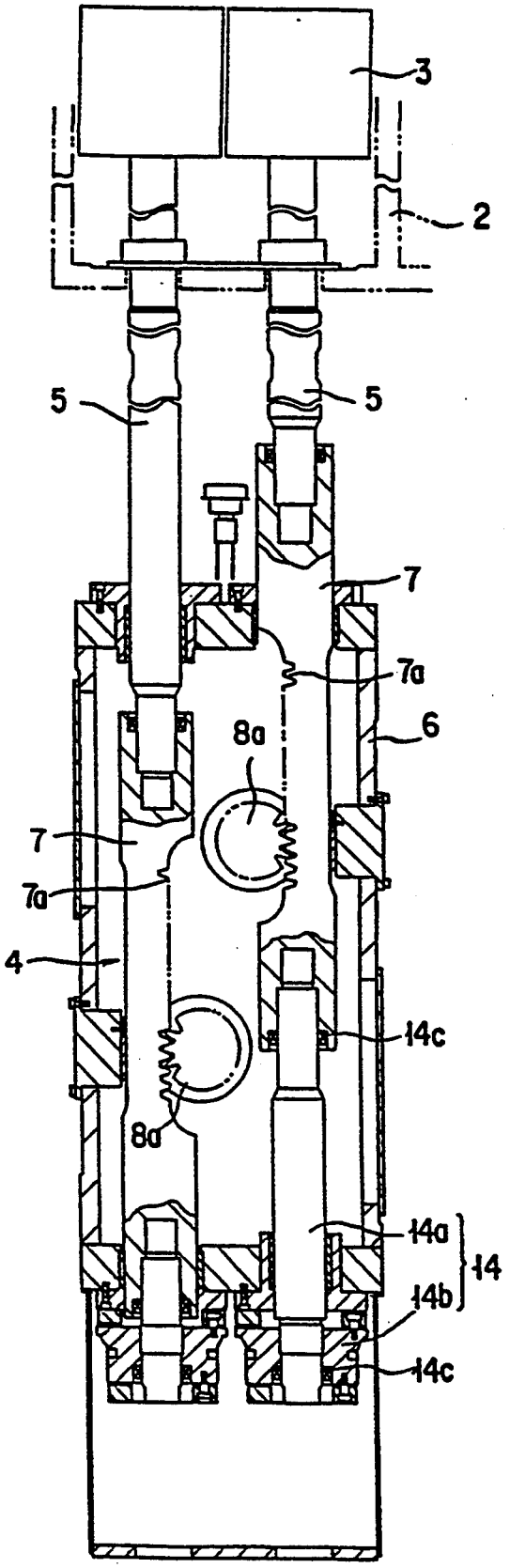
FIG. 13 is a section taken along line XIII—XIII of FIG. 11.
Figure 14:
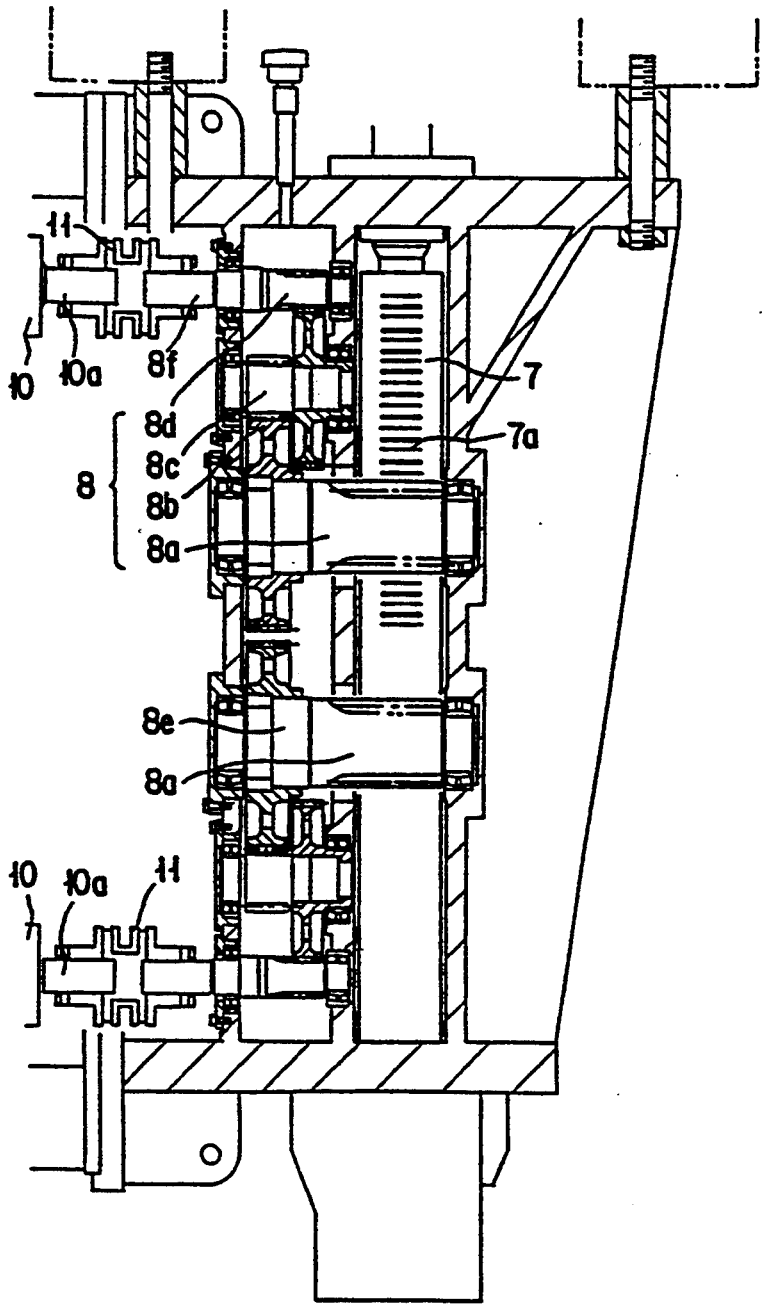
FIG. 14 is an enlarged section of a reduction gear train to be employed in the third embodiment of the die cushion device.

It should be appreciated that when two forming steps are performed in a mutually independent manner with each pad members 31 and 32, the intermediate gears 8*b* of the reduction gear trains 8 are arranged in a spaced apart relationship so that the reduction gear trains may drive the corresponding pad members in a mutually independent manner as shown in FIG. 12. Also, when the two pad members are desired to stroke synchronously, it is desirable to provide the similar construction to the second embodiment, in which the reduction gear trains are mutually cooperated. However, in the case where the reduction gear trains are constructed independently of each other as shown in FIG. 12, the relative positions of the pad members can be matched with each other without providing the mechanical cooperating mechanism as in the former embodiment if the stroke position of the pad member is monitored and the position control of the servo motor is constructed by the feedback system on the basis of the stroke position of the pad member.

Furthermore, when cushion control is to be performed for forming process consisted of six steps W2, . . . W6 employing the die cushion unit in the shown embodiment, three die cushion units 501, 502 and 503 are arranged in such a manner that the center-to-center distances between respective pads 3 become equal to each other. On the pad members 31 and 32 of each die cushion unit 501, 502 and 503, the lower die of each step is supported in the known manner through a cushion pin. With this construction, the pad members 31 and 32 corresponding to respective process steps are driven by the servo motors controlled in the manner similar to that set forth above so that necessary cushion force can be produced at respective steps.

It should be noted that although each die cushion unit is provided two pad members in the foregoing embodiment, number of pad members forming the pad is not necessarily limited to two but can be increased or decreased as required.

With the shown embodiment, by using the die cushion device as a unit, it becomes possible to adapt it for press operations of not only a single step but also multi steps. Also, in the case of a forming process with multi steps, although the forming load is variable at respective steps, the press at an each step can be down at optimal amount of work since the cushion force at the respective pads can be controlled by controlling the servo motor. By this, it becomes possible to employ a smaller main motor and flywheel to reduce the energy for the press operation and also power consumption.

On the other hand, during the press operation, since the servo motor is forcibly driven by lowering of the pad, the regenerated energy may be used for driving for raising the pad or other power source to construct a system with better energy efficiency.

Although the invention has been illustrated and described with respect to exemplary embodiments thereof, it should be understood by those skilled in the art that the foregoing and various other changes, omissions and additions may be made therein and thereto, without departing from the spirit and scope of the present invention. Therefore, the present invention should not be understood as limited to the specific embodiments set out above but to include all possible embodiments which are within the scope encompassed and equivalents thereof with respect to the features set out in the appended claims.

I claim:

1. A die cushion device for a press provided with upper and lower dies comprising:

a pad arranged in a head of the press and adapted to support the lower die from below;

a cushion mechanism supporting said pad and providing a cushion force for the pad;

said cushion mechanism comprising;

a support member supporting said pad and moving in a vertical direction;

a gear mechanism operatively connected to said support member; and a servo motor operatively connected to said gear mechanism;

wherein the cushion force is directly provided for said pad by controlling said servo motor.

2. A die cushion device as set forth in claim 1, wherein said servo motor is an electric motor, and said cushion mechanism includes means for converting rotational driving torque of said servo motor into a reciprocal motion energy.

3. A die cushion device as set forth in claim 1, wherein said servo motor initiates driving immediately before contact of divided dies of the press for preliminarily accelerating the corresponding pad.

4. A die cushion device as set for the in claim 1, wherein a numeric controller controls the speed of said servo motor.

5. A die cushion device as set forth in claim 1, wherein a numeric controller controls the position of said servo motor.

6. A die cushion device as set forth in claim 1, wherein a numeric controller controls the torque of said servo motor.

7. A die cushion device as set forth in claim 1, wherein said pad is supported by a plurality of cushion mechanisms.

8. A die cushion device as set forth in claim 7, wherein each of said plurality of cushion mechanisms comprises a reciprocating body supporting said pad and a gear train for converting the rotational driving torque of said servo motor into a reciprocating driving force of said reciprocating body, at least one gear of said gear train being drivingly cooperated with the corresponding gear provided in other cushion mechanism.

9. A die cushion device as set forth in claim 7, wherein said pad comprises a plurality of pad members operable independently of each other.

10. A die cushion device for a press as set forth in claim 9, further including:

said plurality of pad members form a pad for supporting a lower die from below via a cushion pin;

a rack lever is connected to each of said pad members;

wherein, including said servo motor, there are a plurality of servo motors and a respective one of said servo motors is provided corresponding to each pad member;

a reduction gear train for connecting each said servo motor and said rack lever; and a numeric controller for numerically controlling each servo motor for providing a cushion force for each pad member.

11. A die cushion device as set forth in claim 10, wherein drive shafts of mutually opposingly arranged servo motors are connected via coupling.

12. A die cushion device as set forth in claim 1, wherein said pad and said cushion mechanism form a preliminarily assembled unit, said unit is adapted to be installed in the press.

13. A die cushion device for a press as set forth in claim 12;

a die cushion unit formed by assembling a plurality of pad members forming a pad for supporting a lower die from below via a cushion pin;

a servo motor; and a reduction gear train connecting between a rack lever and the servo motor, said die cushion unit being installed for a head in each step of press molding for producing a cushion force by numerically controlling the servomotor corresponding to press operation in each step.

14. A die cushion device as set forth in claim 13, wherein said pad is constituted of a plurality of pad members.

15. A die cushion device as set forth in claim 14, wherein said plurality of pad members are supported by respectively corresponding rack levers, each rack levers being driven by the corresponding servo motor controlled independently, and the cushion force in each pad is set corresponding to each step in a plurality of forming steps.

16. A die cushion device as set forth in claim 14, wherein said plurality of pad members are supported by respectively corresponding rack levers, each rack levers being driven by the corresponding servo motor controlled synchronously with the other, and the cushion force in each pad is set corresponding to each step in a plurality of forming steps.

* * * * *